US011596236B2

(12) United States Patent
Wu

(10) Patent No.: US 11,596,236 B2
(45) Date of Patent: Mar. 7, 2023

(54) STRUCTURE FOR ADJUSTING SUPPORT FORCE OF LUMBAR PILLOW, AND CHAIR

(71) Applicant: Comfort Office Furniture Co., Ltd Guangdong, Guangzhou (CN)

(72) Inventor: Yao-Chuan Wu, Chiayi Hsien (TW)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 0 days.

(21) Appl. No.: 17/520,790

(22) Filed: Nov. 8, 2021

(65) Prior Publication Data

US 2022/0378211 A1 Dec. 1, 2022

(30) Foreign Application Priority Data

May 25, 2021 (CN) ..... 202121140743.0

(51) Int. Cl.
*A47C 7/46* (2006.01)

(52) U.S. Cl.
CPC ..... *A47C 7/462* (2013.01); *A47C 7/46* (2013.01)

(58) Field of Classification Search
CPC ..... A47C 7/46; A47C 7/462
USPC ..... 297/284.3, 284.4, 284.7
See application file for complete search history.

(56) References Cited

U.S. PATENT DOCUMENTS 4,019,777 A 4/1977 Hayashi
4,714,291 A 12/1987 Hattori
5,174,629 A * 12/1992 Mizushima ..... A47C 7/462 297/284.4
5,462,335 A * 10/1995 Seyler ..... B60N 2/6671 297/284.4
5,466,045 A * 11/1995 Akima ..... A47C 7/462 297/284.4
9,604,559 B2 * 3/2017 Yoo ..... B60N 2/6673
9,796,309 B2 * 10/2017 Song ..... B60N 2/66
10,406,952 B2 * 9/2019 Otake ..... B60N 2/6673
10,960,799 B2 * 3/2021 Lee ..... B60N 2/6673
11,305,676 B2 * 4/2022 Eichhorn ..... B60N 2/0232
(Continued)

FOREIGN PATENT DOCUMENTS

CN 111436786 A 7/2020

OTHER PUBLICATIONS

European search report and European search opinion dated Jun. 3, 2022; EP 21214469.5.

*Primary Examiner* — Rodney B White
(74) *Attorney, Agent, or Firm* — IPro, PLLC

(57) ABSTRACT

The structure for adjusting a support force of a lumbar pillow includes: a backrest bracket, a lumbar pillow, an elastic support, and an adjustment mechanism; wherein a top of the lumbar pillow is flexibly connected to a front side of the backrest bracket; one end of the elastic support is connected to a back of the lumbar pillow, and the other end of the elastic support is provided with a slider, the slider being provided with an internally threaded hole; the adjustment mechanism includes a lead screw; and in response to the lead screw rotating with respect to the backrest bracket, the slider slides upward and downward along the vertical direction of the backrest bracket to change a support angle of the elastic support for the lumbar pillow, such that a magnitude of the support force of the elastic support to the lumbar pillow is adjusted.

20 Claims, 5 Drawing Sheets

(56) References Cited

U.S. PATENT DOCUMENTS

| | | | | |
|---|---|---|---|---|
| 2008/0296958 | A1* | 12/2008 | Peterson | A47C 7/40<br>297/452.18 |
| 2014/0125103 | A1* | 5/2014 | Suzuki | B60N 2/0232<br>297/284.7 |
| 2014/0346827 | A1* | 11/2014 | Suzuki | B60N 2/66<br>297/284.7 |
| 2015/0091349 | A1* | 4/2015 | Hong | B60N 2/6673<br>297/284.7 |
| 2015/0305506 | A1* | 10/2015 | Suzuki | A47C 3/00<br>297/284.4 |

* cited by examiner

STRUCTURE FOR ADJUSTING SUPPORT FORCE OF LUMBAR PILLOW, AND CHAIR

CROSS REFERENCE TO RELATED APPLICATIONS

The present disclosure claims priority to Chinese Patent Application No. 202121140743.0, filed with the Chinese Patent Office on May 25, 2021, titled "STRUCTURE FOR ADJUSTING SUPPORT FORCE OF LUMBAR PILLOW, AND CHAIR", the entire contents of which are incorporated herein by reference.

TECHNICAL FIELD

Embodiments of the present disclosure relate to the technical field of chairs, and in particular, relate to a structure for adjusting a support force of a lumbar pillow, and a chair thereof.

BACKGROUND

Chairs are commonly used furniture in daily life. People who are accustomed to long-time sitting in the chair easily suffer from fatigue and soreness of back muscles or even lumbar spinal diseases. Therefore, the lumbar of the human body needs to be supported by a lumbar pillow of the chair, so as to reduce a force applied to the lumbar.

At present, the lumbar pillow on the back of the chair is only capable of adjusting positions, for example, upward and downward position adjustment. As such, different magnitudes of support force for the lumbar fail to be provided for different users.

SUMMARY

In view of the above problem, embodiments of the present disclosure provide a structure for adjusting a support force of a lumbar pillow and a chair, to adjust a magnitude of the support force of the lumbar pillow according to different user needs.

According to one aspect of the embodiments of the present disclosure, a structure for adjusting a support force of a lumbar pillow is provided. The structure includes: a backrest bracket, a lumbar pillow, an elastic support, and an adjustment mechanism; wherein a top of the lumbar pillow is flexibly connected to a front side of the backrest bracket; one end of the elastic support is connected to a back of the lumbar pillow, and the other end of the elastic support is provided with a slider, the slider being provided with an internally threaded hole; the adjustment mechanism includes a lead screw, wherein the lead screw runs through the internally threaded hole, the lead screw is rotatably connected to the backrest bracket, and an extension direction of a rotation axis of the lead screw with respect to the backrest bracket is consistent with a vertical direction of the backrest bracket; and in response to the lead screw rotating with respect to the backrest bracket, the slider slides upward and downward along the vertical direction of the backrest bracket to change a support angle of the elastic support for the lumbar pillow, such that a magnitude of the support force of the elastic support to the lumbar pillow is adjusted.

In an optional embodiment, in the vertical direction of the backrest bracket, a maximum height, on the lumbar pillow, of the end of the elastic support connected to the lumbar pillow is less than a minimum height, on the lead screw, of the end of the elastic support provided with the slider.

In an optional embodiment, the adjustment mechanism further includes a horizontal rotation shaft; wherein the horizontal rotation shaft is rotatably connected to the backrest bracket, two ends of the horizontal rotation shaft extend along a widthwise direction of the backrest bracket and are each fixedly connected to a handle, the handle being disposed outside the backrest bracket, and a middle portion of the horizontal rotation shaft is provided with a driving bevel gear; and one end of the lead screw is provided with a driven bevel gear, wherein the driven bevel gear is meshed with the driving bevel gear, and the lead screw is arranged to be perpendicular to the horizontal rotation shaft.

In an optional embodiment, the elastic support includes a first arc-shaped elastic piece and a second arc-shaped elastic piece; wherein an inwardly recessed surface of the first arc-shaped elastic piece is arranged to be opposite to an inwardly recessed surface of the second arc-shaped elastic piece, one end of each of the first arc-shaped elastic piece and the second arc-shaped elastic piece is fixedly connected to a bottom of the back of the lumbar pillow, the other end of the first arc-shaped elastic piece is fixed to the backrest bracket, and the second arc-shaped elastic piece is provided with the slider.

In an optional embodiment, a third arc-shaped elastic piece is further arranged between the first arc-shaped elastic piece and the second arc-shaped elastic piece; wherein an inwardly recessed surface of the third arc-shaped elastic piece is opposite to the first arc-shaped elastic piece, one end of the third arc-shaped elastic piece is fixedly connected to the backrest bracket, and the other end of the third arc-shaped elastic piece is slidably sleeved onto an end, proximal to the lumbar pillow, on a middle section of the second arc-shaped elastic piece.

In an optional embodiment, two sides of an end, proximal to the lumbar pillow, of the third arc-shaped elastic piece, are respectively provided with a first lateral stop portion and a second lateral stop portion; wherein a surface, facing the second lateral stop portion, of a bottom of the first lateral stop portion is provided with a first abutting portion, a surface, facing the first lateral stop portion, of a bottom of the second lateral stop portion is provided with a second abutting portion, the second arc-shaped elastic piece is disposed between the first lateral stop portion and the second lateral stop portion, and a bottom of the second arc-shaped elastic piece is disposed above tops of the first abutting portion and the second abutting portion.

In an optional embodiment, a lateral side of a top of the end at which the third arc-shaped elastic piece and the second arc-shaped elastic piece are slidably connected is provided with a display port, and a position, corresponding to the display port, on the second arc-shaped elastic piece is provided with a position scale mark; wherein the position scale mark is arranged along a direction in which the second arc-shaped elastic piece is slidable relative to the third arc-shaped elastic piece, and the position scale mark is configured to indicate a magnitude of an elastic force applied by the elastic support to the lumbar pillow.

In an optional embodiment, the handle is cylindrical and the driving bevel gear is coaxially arranged on the horizontal rotation shaft, and an outer circumferential wall of the handle is provided with at least one position mark; wherein each of the at least one position mark includes a plurality of circular protrusions spaced apart from each other around a circumferential direction of the handle, radii of the plurality of circular protrusions progressively decreasing or increasing along the circumferential direction of the handle, and the position mark is configured to indicate a rotation direction for adjusting the magnitude of the support force.

In an optional embodiment, a backrest is fixedly connected to a front side of the backrest bracket; wherein a bottom of the backrest is flexibly connected to the top of the lumbar pillow.

In an optional embodiment, the adjustment mechanism further includes a connection plate, a first fixing seat, and a second fixing seat; wherein the connection plate is fixed to a side, opposite to the back of the lumbar pillow, of the backrest bracket, and the connection plate is provided with a fixing portion; wherein the fixing portion, the first fixing seat, and the second fixing seat are successively spaced apart from top to bottom along the vertical direction of the backrest bracket; wherein the fixing portion is fixedly connected to one end, distal from the lumbar pillow, of the first arc-shaped elastic piece, wherein the first fixing seat is rotatably connected to one end of the lead screw, and the second fixing seat is rotatably connected to the other end of the lead screw and the horizontal rotation shaft.

In an optional embodiment, the second fixing seat is provided with an accommodating groove that is fitted with the driving bevel gear and the driven bevel gear, such that the driving bevel gear and the driven bevel gear are mounted on the second fixing seat.

In an optional embodiment, the other end, distal from the slider, of the elastic support is connected to a middle portion of the back of the lumbar pillow, or, is connected to a bottom of the back of the lumbar pillow.

In an optional embodiment, along the vertical direction of the backrest bracket, a minimum height, on the lumbar pillow, of one end of the elastic support connected to the lumbar pillow is greater than a maximum height, on the lead screw, of one end, provided with the slider, of the elastic support.

In an optional embodiment, the position scale mark is a plurality of color blocks successively arranged on the lateral side of the top of the second arc-shaped elastic piece along the lengthwise direction thereof, and disposed along the direction from one end that the second arc-shaped elastic piece is connected to the lumbar pillow to the other end.

According to another aspect of the embodiments of the present disclosure, a chair is provided. The chair includes the structure for adjusting the support force of the lumbar pillow as described above.

In the structure for adjusting the support force of the lumbar pillow according to the embodiments of the present disclosure, one end, provided with the slider, of the elastic support is driven by the lead screw to slide upward and downward along the vertical direction of the backrest bracket, such that the support angle of the elastic support for the lumbar pillow changes, and a deformation amount of the elastic support between the lumbar pillow and the backrest bracket may also change, such that an action force of the elastic support on the lumbar pillow is adjusted, and a magnitude of the support force of the lumbar pillow for the lumbar of the human body is adjusted. In this way, the adjustment is convenient, and the magnitude of the support force of the chair against the lumbar of the human body may change according to the different body shapes and requirements of the user, such that the lumbar of the human body is protected, and the user experience is improved.

The above description only summarizes the technical solutions of the present disclosure. Specific embodiments of the present disclosure are described hereinafter to better and clearer understand the technical solutions of the present disclosure, to practice the technical solutions based on the disclosure of the specification and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference signs denote like parts. In the drawings.

1—structure for adjusting support force of lumbar pillow;

100—backrest bracket;

200—lumbar pillow;

300—elastic support; 310—slider; 311—internally threaded hole; 320—first arc-shaped elastic piece; 3230—second arc-shaped elastic piece; 340—third arc-shaped elastic piece; 341—first lateral stop portion; 3411—first abutting portion; 342—second lateral stop portion; 3421—second abutting portion; 343—display port;

400—adjustment mechanism; 410—lead screw; 411—driven bevel gear; 420—horizontal rotation shaft; 421—handle; 4211—circular protrusion; 422—driving bevel gear; 430—connection plate; 430—fixing portion; 440—first fixing seat; 450—second fixing seat; 451—accommodating groove;

500—backrest; and

2—chair 2; 3—chair body 3.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Figure 1:
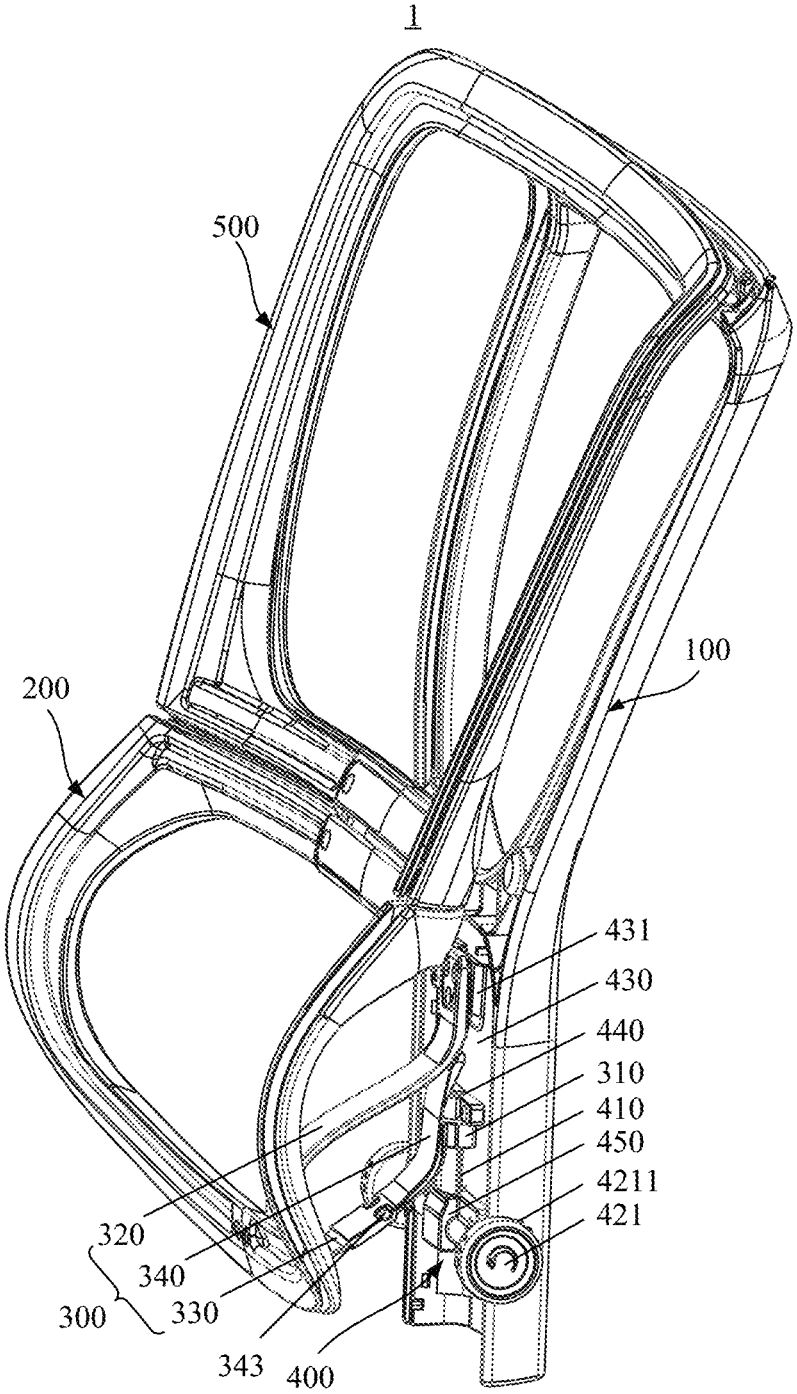
FIG. 1 is a schematic structural view of a structure for adjusting a support force of a lumbar pillow according to an embodiment of the present disclosure.
Figure 2:
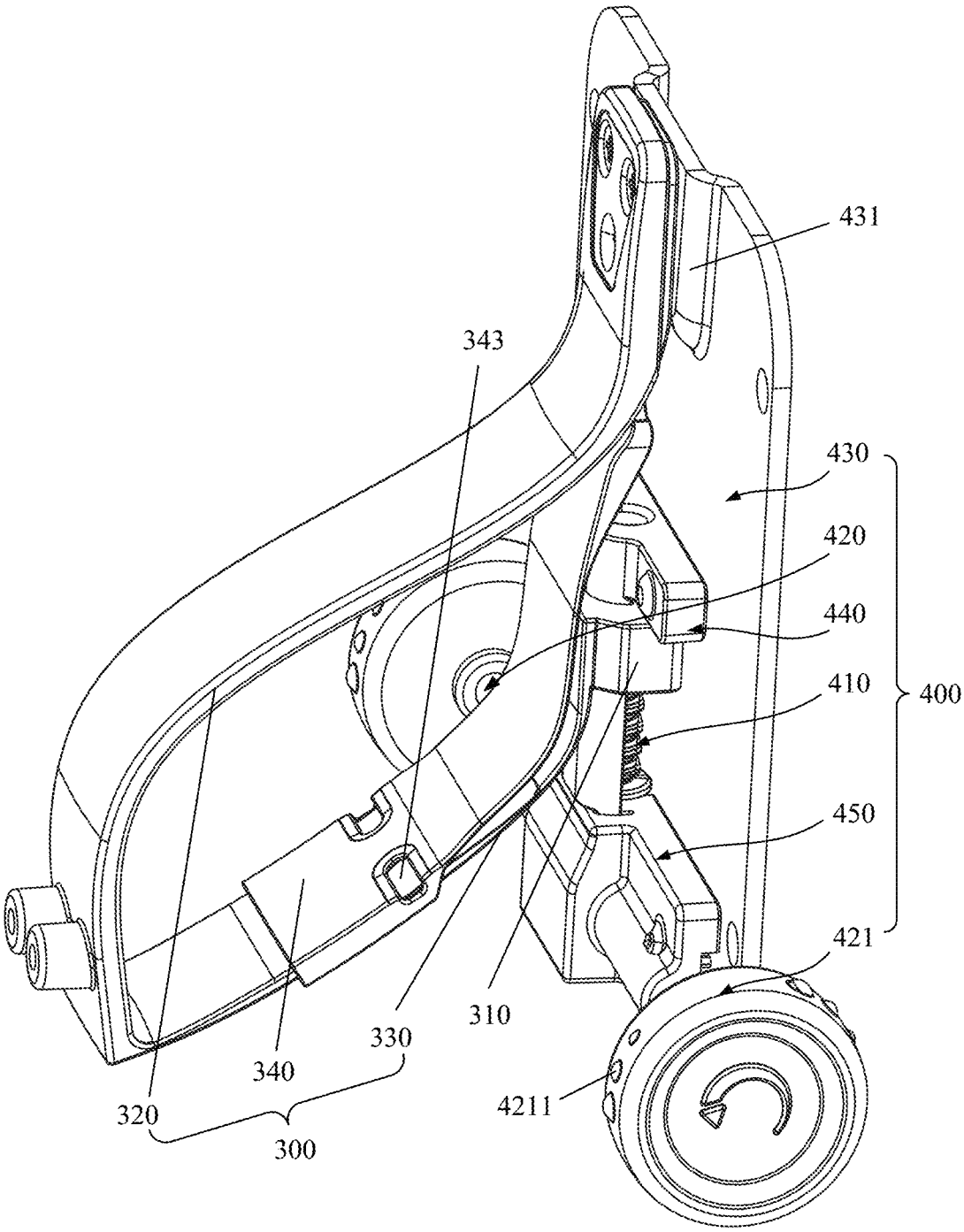
FIG. 2 is a schematic structural view of connection between an elastic support and an adjustment mechanism according to an embodiment of the present disclosure.
Figure 3:
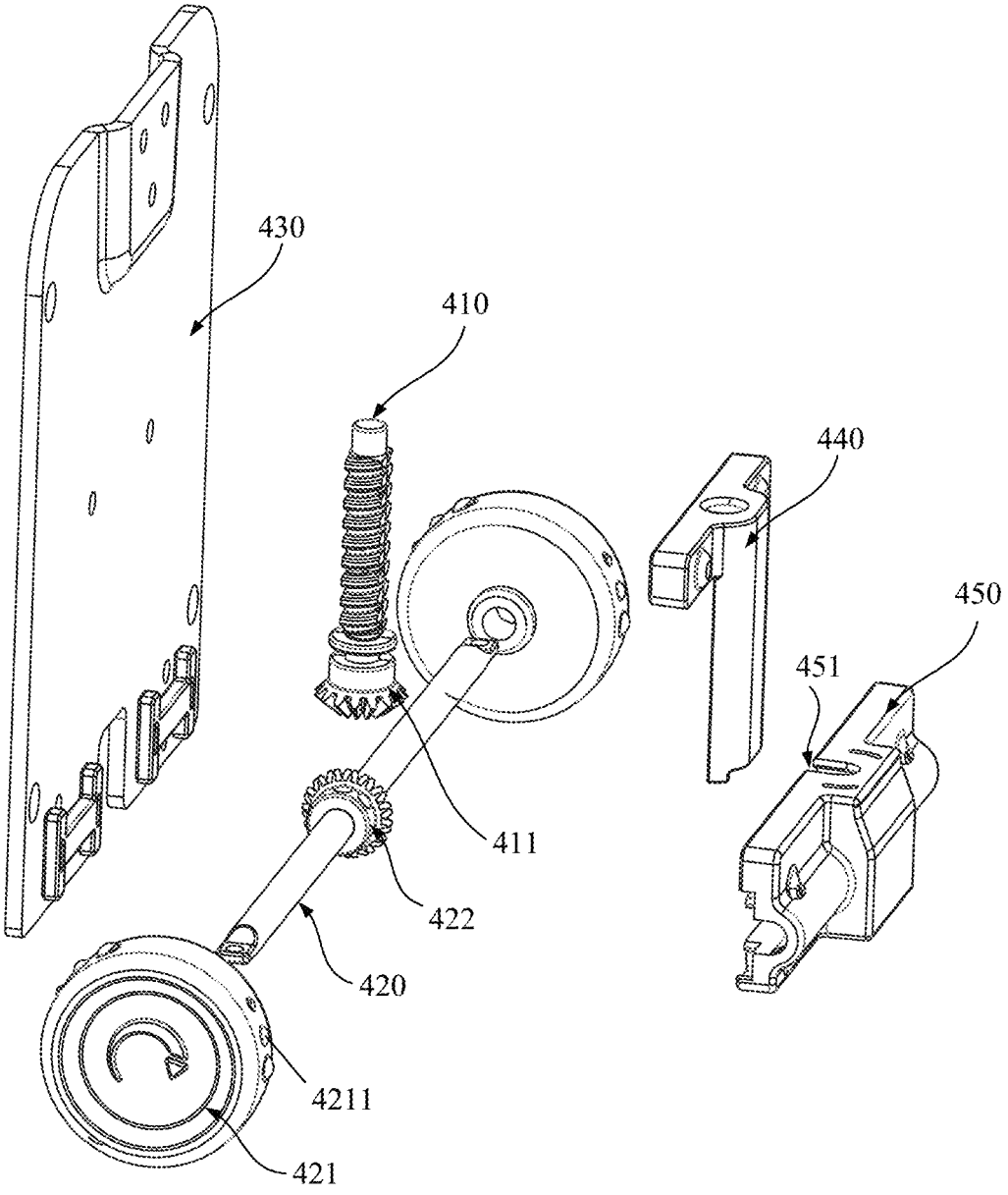
FIG. 3 is a schematic exploded view of the adjustment mechanism according to an embodiment of the present disclosure.
Figure 4:
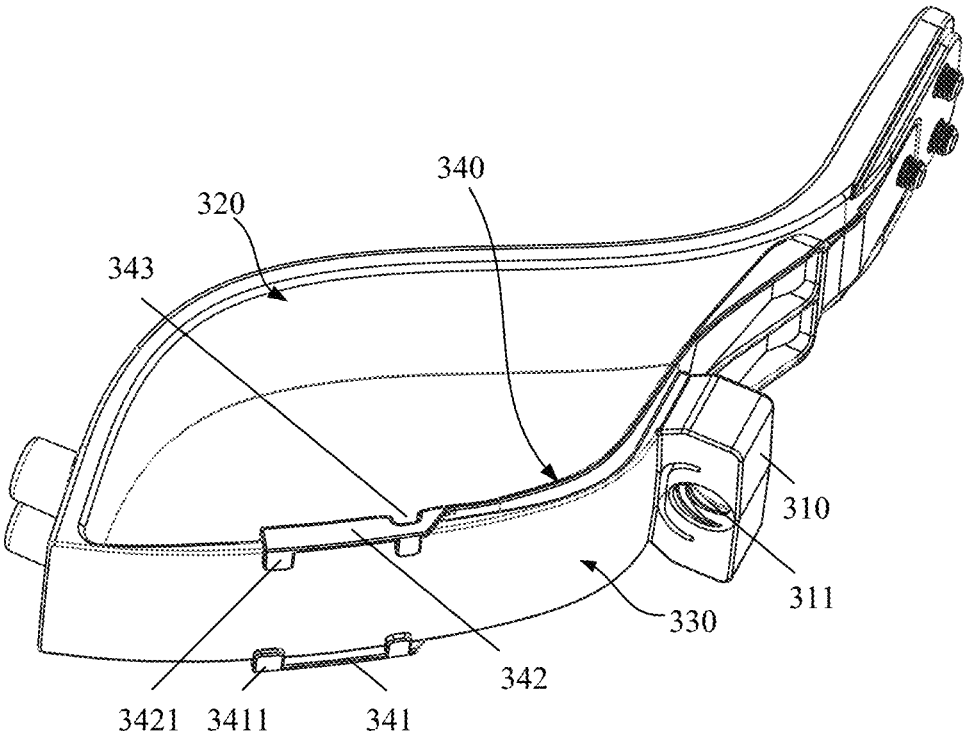
FIG. 4 is a schematic structural view of the elastic support according to an embodiment of the present disclosure.

Referring to FIG. 1 to FIG. 4, FIG. 1 is a schematic structural view of a structure for adjusting a support force of a lumbar pillow according to an embodiment of the present disclosure; FIG. 2 is a schematic structural view of connection between an elastic support 300 and an adjustment mechanism 400 according to an embodiment of the present disclosure; FIG. 3 is a schematic exploded view of the adjustment mechanism 400 according to an embodiment of the present disclosure; and FIG. 4 is a schematic structural view of the elastic support 300 according to an embodiment of the present disclosure.

The structure 1 includes a backrest bracket 100, a lumbar pillow 200, an elastic support 300, and an adjustment mechanism 400. A top of the lumbar pillow 200 is flexibly connected to a front side of the backrest bracket 100. One end of the elastic support 300 is connected to a back of the lumbar pillow 200, and the other end of the elastic support 300 is provided with a slider 310. The slider 310 is provided with an internally threaded hole 311. The adjustment mechanism 400 includes a lead screw 410. The lead screw 410 runs through the internally threaded hole 311. The lead screw 410 is rotatably connected to the backrest bracket 100, and an extension direction of a rotation axis about which the lead screw 410 is rotatable relative to the backrest bracket 100 is consistent with a vertical direction of the backrest bracket 100. In the case that the lead screw 410 rotates relative to the backrest bracket 100, the slider 310 slides upward and downward along the vertical direction of the backrest bracket 100 to adjust a magnitude of a support force applied by the elastic support 300 to the lumbar pillow 200.

The front side of the backrest bracket 100 refers to a side, facing a human body, of the backrest bracket 100, that is, the side facing the front of the chair, in the case that the human body is normally seated on the chair. Likewise, the back of the lumbar pillow 200 refers to a side, facing away from a human body, of the lumbar pillow 200, that is, the side facing the back of the chair, in the case that the human body is normally seated on the chair. The vertical direction of the backrest bracket 100 refers to a height direction of the chair in the case that the chair is normally placed. The extension direction of the rotation axis about which the lead screw 410 is rotatable relative to the backrest bracket 100 may be the vertical direction of the backrest bracket 100 (equivalent to a case where the lead screw 410 is vertically arranged on the backrest bracket 100), or may be approximately parallel to the vertical direction. The slider 310 is mated with male threads of the lead screw 410 through the internally threaded hole 311, such that rotational movement of the lead screw 410 relative to the backrest bracket 100 may be converted into linear movement of the slider 310 along an axial direction of the lead screw 410.

It should be noted that the other end, distal from the slider 310, of the elastic support 300 may be connected to a middle portion of the back of the lumbar pillow 200 or may be connected to a bottom of the back of the lumbar pillow 200.

In the case that one end, provided with the slider 310, of the elastic support 300 slides upward and downward along the vertical direction of the backrest bracket 100, a support angle of the elastic support 300 for the lumbar pillow 200 changes, and the elastic support 300 may be elastically deformed. Since the elastic support 300 is disposed between the lumbar pillow 200 and the backrest bracket 100, in the case that elastic deformation of the elastic support 300 increases, an elastic force of the elastic support 300 against the back of the lumbar pillow 200 may also increase. At this time, the support force of the lumbar pillow 200 to the lumbar of the human body also increases. In the case that the elastic deformation of the elastic support 300 decreases, the elastic force of the elastic support 300 to the back of the lumbar pillow 200 also decreases. At this time, the support force of the lumbar pillow 200 to the lumbar of the human body also decreases.

In the structure 1 for adjusting the support force of the lumbar pillow according to this embodiment, one end, provided with the slider 310, of the elastic support 300 is driven by the lead screw 410 to slide upward and downward along the vertical direction of the backrest bracket 100, such that the support angle of the elastic support 300 for the lumbar pillow 200 changes, and a deformation amount of the elastic support 300 between the lumbar pillow 200 and the backrest bracket 100 may also change, such that an action force of the elastic support 300 on the lumbar pillow 200 is adjusted, and a magnitude of the support force of the lumbar pillow 200 for the lumbar of the human body is adjusted. In this way, the adjustment is convenient, and the magnitude of the support force of the chair against the lumbar of the human body may change according to the different body shapes and requirements of the user, such that the lumbar of the human body is protected, and the user experience is improved.

In some embodiments, along the vertical direction of the backrest bracket 100, a maximum height, on the lumbar pillow 200, of one end of the elastic support 300 connected to the lumbar pillow 200 is less than a minimum height, on the lead screw 410, of one end, provided with the slider 310, of the elastic support 300.

In this way, in the case that the lead screw 410 drives the slider 310 to move from top to bottom, the support force of the elastic support 300 to the lumbar pillow 200 increases. In the case that the lead screw 410 drives the slider 310 to move from bottom to top, the support force of the elastic support 300 to the lumbar pillow 200 progressively decreases.

It may be understood that, in some other embodiments, along the vertical direction of the backrest bracket 100, a minimum height, on the lumbar pillow 200, of one end of the elastic support 300 connected to the lumbar pillow 200 may also be greater than a maximum height, on the lead screw 410, of one end, provided with the slider 310, of the elastic support 300. At this time, in the case that the lead screw 410 drives the slider 310 to move from top to bottom, the support force of the elastic support 300 to the lumbar pillow 200 progressively decreases. In the case that the lead screw 410 drives the slider 310 to move from bottom to top, the support force of the elastic support 300 to the lumbar pillow 200 progressively increases.

In some embodiments, the adjustment mechanism 400 further includes a horizontal rotation shaft 420; wherein the horizontal rotation shaft 420 is rotatably connected to the backrest bracket 100, and two ends of the horizontal rotation shaft 420 extend along a widthwise direction of the backrest bracket 100 and are each fixedly connected to a handle 421. The handle 421 is disposed outside the backrest bracket 100, and a middle portion of the horizontal rotation shaft 420 is provided with a driving bevel gear 422. One end of the lead screw 410 is provided with a driven bevel gear 411, wherein the driven bevel gear 411 is meshed with the driving bevel gear 422, and the lead screw 410 is arranged to be perpendicular to the horizontal rotation shaft 420.

The widthwise direction of the backrest bracket 100 is a left-right direction in the case that the chair is normally placed, that is, the left-right direction of the backrest bracket 100. The handle 421 and the horizontal rotation shaft 420 may be fixedly connected by screwing, snapping and other detachable connection fashions, or may be also fixedly connected by welding, integral molding and other non-detachable fashions. The driving bevel gear 422 may be detachably sleeved on a middle portion of the horizontal rotation shaft 420 through a pin, may be integrally formed with the horizontal rotation shaft 420, or may be connected and fixed in other fashions, such as welding or screwing. The driven bevel gear 411 and the lead screw 410 may be designed as an integral structure, or may be detachably connected to one end of the lead screw 410 by a pin, a screw, or the like.

In this embodiment, the lead screw 410 engages with the horizontal rotation shaft 420 by meshing between the driving bevel gear 422 and the driven bevel gear 411, such that a user may drive the lead screw 410 to rotate by using the handle 421 at both ends. In this way, the user may simultaneously or separately perform the adjustment by left and right hands, different user's hand-using habits may be satisfied, and the operation is simple, convenient, and labor-saving.

In some embodiments, the handle 421 is cylindrical and the driving bevel gear 422 is coaxially arranged on the horizontal rotation shaft 420, and an outer circumferential wall of the handle 421 is provided with at least one position mark; wherein each of the at least one position mark includes a plurality of circular protrusions 4211 spaced apart from each other around a circumferential direction of the handle 421, radii of the plurality of circular protrusions 4211 progressively decreasing or increasing along the circumferential direction of the handle 421, and the position mark is configured to indicate a rotation direction for adjusting a magnitude of the support force.

The number of position marks may be 1, 2, or more, and the number of circular protrusions 4211 in each position mark may be 3, 4, 5, or the like, which are not specifically limited herein.

As an example, in the case that the plurality of circular protrusions 4211 progressively become smaller in a clockwise direction along an outer circumferential wall of the handle 421, in response to the user rotating the handle 421 clockwise, the support force of the lumbar pillow 200 may decrease; and in response to the user rotating the handle 421 counterclockwise, the support force of the lumbar pillow 200 may increase.

In this embodiment, the position mark composed of the plurality of circular protrusions 4211 are disposed on the outer circumferential wall of the cylindrical handle 421, a friction force on the surface of the handle 421 may be increase, which is convenient for rotation and adjustment by the user to avoid slipping. In addition, the user may quickly identify a direction of rotation through the changes of the radii of the circular protrusions 4211 to cause the support force to increase or decrease.

It may be understood that, in some other embodiments, the handle 421 may be also in other shapes, such as a prismatic shape.

In some embodiments, the elastic support 300 includes a first arc-shaped elastic piece 320 and a second arc-shaped elastic piece 330; wherein an inwardly recessed surface of the first arc-shaped elastic piece 320 is arranged to be opposite to an inwardly recessed surface of the second arc-shaped elastic piece 330, one end of each of the first arc-shaped elastic piece 320 and the second arc-shaped elastic piece 330 is fixedly connected to a bottom of the back of the lumbar pillow 200, the other end of the first arc-shaped elastic piece 320 is fixed to the backrest bracket 100, and the second arc-shaped elastic piece 330 is provided with the slider 310.

The first arc-shaped elastic piece 320 and the second arc-shaped elastic piece 330 may be designed as an integral structure, that is, one ends of the first arc-shaped elastic piece 320 and the second arc-shaped elastic piece 330 connected to the lumbar pillow 200 are designed as an integral structure, and the other ends of the first arc-shaped elastic piece 320 and the second arc-shaped elastic piece 330 are separated from each other.

For a single elastic support member 300, since the single elastic support member 300 needs to undergo elastic deformation in response to sliding upward and downward to change the magnitude of the support force to the lumbar pillow 200, an overall structural strength thereof is not too great. In this embodiment, by configuring the first arc-shaped elastic piece 320 and second arc-shaped elastic piece 330 that are mated with each other, the first arc-shaped elastic piece 320 is a primary support for the back of the lumbar pillow 200, and the second arc-shaped elastic piece 330 is a secondary support for the back of the lumbar pillow 200. In addition, up-and-down sliding of one end, provided with the slider 310, of the second arc-shaped elastic piece 330 may adjust the support angle of the back of the lumbar pillow 200.

It should be noted that, in some other embodiments, the end at which the first arc-shaped elastic piece 320 is connected to the second arc-shaped elastic piece 330 may also be fixed at the middle portion of the back of the lumbar pillow 200.

In some other embodiments, a third arc-shaped elastic piece 340 is further arranged between the first arc-shaped elastic piece 320 and the second arc-shaped elastic piece 330; wherein an inwardly recessed surface of the third arc-shaped elastic piece 340 is opposite to the first arc-shaped elastic piece 320, one end of the third arc-shaped elastic piece 340 is fixedly connected to the backrest bracket 100, and the other end of the third arc-shaped elastic piece 340 is slidably sleeved onto an end, proximal to the lumbar pillow 200, on a middle section of the second arc-shaped elastic piece 330.

The other ends, distal from the lumbar pillow 200, of the first arc-shaped elastic piece 320 and the third arc-shaped elastic piece 340 may be connected to the same position of the backrest bracket 100.

In the case that the lead screw 410 drives the slider 310 to slide upward and downward along the vertical direction, the third arc-shaped elastic piece 340 is always slidably connected to a middle portion, between the two ends, of the second arc-shaped elastic piece 330. In this way, the third arc-shaped elastic piece 340 plays a role in supporting and protecting the second arc-shaped elastic piece 330.

Specifically, two sides of an end, proximal to the lumbar pillow 200, of the third arc-shaped elastic piece 340, are respectively provided with a first lateral stop portion 341 and a second lateral stop portion 342; wherein a surface, facing the second lateral stop portion 342, of a bottom of the first lateral stop portion 341 is provided with a first abutting portion 3411, a surface, facing the first lateral stop portion 341, of a bottom of the second lateral stop portion 342 is provided with a second abutting portion 3421, the second arc-shaped elastic piece 330 is disposed between the first lateral stop portion 341 and the second lateral stop portion 342, and a bottom of the second arc-shaped elastic piece 330 is disposed above tops of the first abutting portion 3411 and the second abutting portion 3421.

The first lateral stop portion 341 may be disposed on a right side of the third arc-shaped elastic piece 340, and the second lateral stop portion 342 may be disposed on a left side of the third arc-shaped elastic piece 340. The first lateral stop portion 341 and the second lateral stop portion 342 are configured to restrict the second arc-shaped elastic piece 330 from detaching from the third arc-shaped elastic piece 340 along the left and right sides. The first abutting portion 3411 and the second abutting portion 3421 are both disposed at the bottom of the second arc-shaped elastic piece 330 to support the second arc-shaped elastic piece 330, and to prevent the second arc-shaped elastic piece 330 from detaching from the third arc-shaped elastic piece 340 in the case that the end, provided with the slider 310, of the second arc-shaped elastic piece 330 slides upward and downward. In some embodiments, a lateral side of a top of the end at which the third arc-shaped elastic piece 340 and the second arc-shaped elastic piece 330 are slidably connected is provided with a display port 343, and a position, corresponding to the display port 343, on the second arc-shaped elastic piece 330 is provided with a position scale mark (not illustrated); wherein the position scale mark is arranged along a direction in which the second arc-shaped elastic piece 330 is slidable relative to the third arc-shaped elastic piece 340, and the position scale mark is configured to indicate a magnitude of an elastic force applied by the elastic support 300 to the lumbar pillow 200.

As an example, the position scale mark may be a plurality of color blocks successively arranged on the lateral side of the top of the second arc-shaped elastic piece 330 along the lengthwise direction thereof (that is, the direction in which the second arc-shaped elastic piece 330 slides relative to the third arc-shaped elastic piece 340). Assuming that the color blocks are green, yellow, and red, and disposed along the direction from one end that the second arc-shaped elastic piece 330 is connected to the lumbar pillow 200 to the other end, then in the case that one end, provided with the slider 310, of the second arc-shaped elastic piece 330 slides from top to bottom, changes of the color blocks from green to yellow and then to red may be observed from the display port 343. In this case, the support force of the lumbar pillow changes from small to large.

It should be noted that the arrangement direction and colors of the color blocks may be defined according to actual needs, which are not limited herein. In other embodiments, the position scale mark may also be set in other ways such as a scale line or text, which is not limited herein.

In this embodiment, the top of the end at which the third arc-shaped elastic piece 340 and the second arc-shaped elastic piece 330 are slidably connected is provided with the display port, and a position, corresponding to the display port 343, on the second arc-shaped elastic piece 330 is provided with the position scale mark.

In some specific embodiments, a backrest 500 is fixedly connected to a front side of the backrest bracket 100 and positioned above the lumbar pillow 200, and a bottom of the backrest 500 is flexibly connected to the top of the lumbar pillow 200. Specifically, the bottom of the backrest 500 and the top of the lumbar pillow 200 are connected by a flexible connector. The flexible connector may be made of an elastic material such as silica gel or rubber. The flexible connector may also be a metal elastic sheet.

In some embodiments, the adjustment mechanism 400 further includes a connection plate 430, a first fixing seat 440, and a second fixing seat 450. The connection plate 430 is fixed to a side, opposite to the back of the lumbar pillow 200, of the backrest bracket 100, and the connection plate 430 is provided with a fixing portion 431. The fixing portion 431, the first fixing seat 440, and the second fixing seat 450 are successively spaced apart from top to bottom along the vertical direction of the backrest bracket 100. The fixing portion 431 is fixedly connected to one end, distal from the lumbar pillow 200, of the first arc-shaped elastic piece 320, the first fixing seat 440 is rotatably connected to one end of the lead screw 410, and the second fixing seat 450 is rotatably connected to the other end of the lead screw 410 and the horizontal rotation shaft 420. The second fixing seat 450 is provided with an accommodating groove 451 that is fitted with the driving bevel gear 422 and the driven bevel gear 411, such that the driving bevel gear 422 and the driven bevel gear 411 are mounted on the second fixing seat 450.

Figure 5:
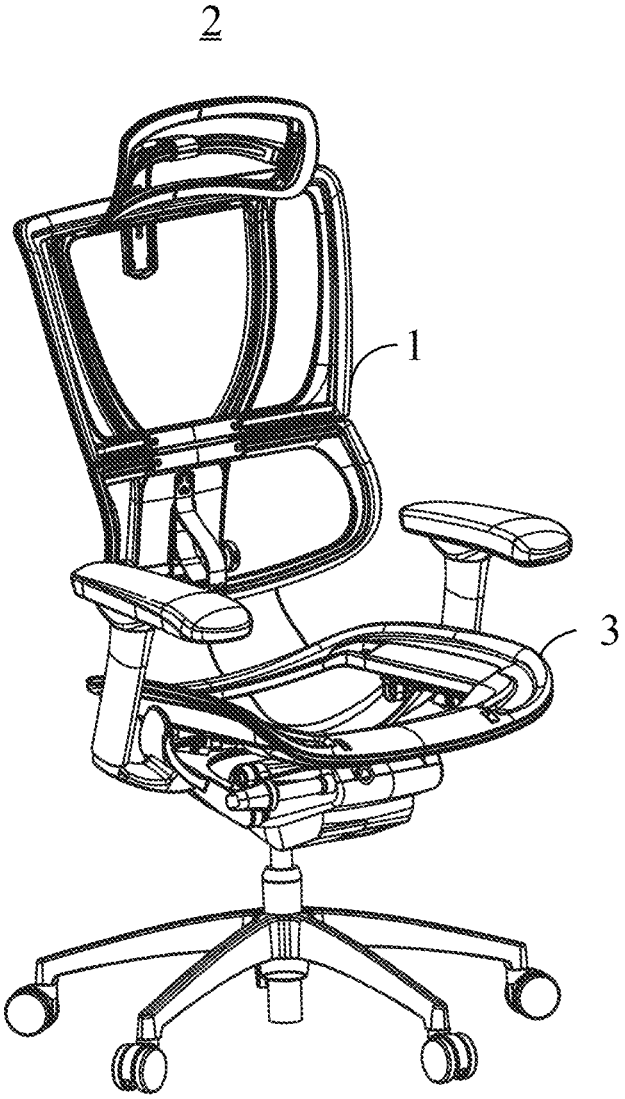
FIG. 5 is a schematic structural view of a chair according to an embodiment of the present disclosure. Reference numerals in the embodiments and denotations thereof.

As illustrated in FIG. 5, another aspect of the present disclosure further provides a chair 2. The chair 2 includes the structure 1 for adjusting the support force of the lumbar pillow as described above. As illustrated in FIG. 6, specifically, the chair 2 further includes a chair body 3. The structure 1 for adjusting the support force of the lumbar pillow is mounted on the chair body 3. The chair 2 according to this embodiment is capable of achieving the same beneficial effects as the structure 1 for adjusting the support force of the lumbar pillow, which are not described herein any further.

It should be noted that unless otherwise specified, the technical terms and scientific terms used in the present disclosure shall express general meanings that may be understood by a person skilled in the art.

In the description of the embodiments of the present disclosure, it should be understood that the technical terms "upper," "lower," "front," "rear," "vertical," "horizontal," "top," "bottom," "inner," "outer," "clockwise," "counterclockwise," "axial," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "more" or "a plurality of" signifies at least two, unless otherwise specified.

In the description of the embodiments of the present disclosure, it should be noted that unless otherwise specified and defined, the terms "mounted," "coupled," "connected," "fixed," and derivative forms thereof shall be understood in a broad sense, which, for example, may be understood as fixed connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In the description of the embodiments of the present disclosure, unless otherwise specified or defined, by defining that a first feature is arranged "above," or "below," or "beneath" a second feature, it means that the first feature is in direct contact with the second feature, or the first feature is in indirect contact with the second feature via an intermediate medium. In addition, by defining that a first feature is arranged "over," "above," and "under" a second feature, it means that the first feature is rightly over the second feature or is obliquely above the second feature, or the horizontal height of the first feature is greater than that of the second feature. In addition, by defining that a first feature is arranged "under," or "below," or "beneath" a second feature, it means that the first feature is rightly under the second feature or is obliquely below the second feature, or the horizontal height of the first feature is less than that of the second feature.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A structure for adjusting a support force of a lumbar pillow, comprising: a backrest bracket, a lumbar pillow, an elastic support, and an adjustment mechanism; wherein a top of the lumbar pillow is flexibly connected to a front side of the backrest bracket;

a first end of the elastic support is connected to a back of the lumbar pillow, and a second end of the elastic support is provided with a slider, the slider being provided with an internally threaded hole;

the adjustment mechanism comprises a lead screw, wherein the lead screw runs through the internally threaded hole, the lead screw is rotatably connected to the backrest bracket, and an extension direction of a rotation axis of the lead screw with respect to the backrest bracket is consistent with a vertical direction of the backrest bracket; and in response to the lead screw rotating with respect to the backrest bracket, the slider slides upward and downward along the vertical direction of the backrest bracket to change a support angle of the elastic support for the lumbar pillow, such that a magnitude of the support force of the elastic support to the lumbar pillow is adjusted.

2. The structure for adjusting the support force of the lumbar pillow according to claim 1, wherein in the vertical direction of the backrest bracket, a maximum height of the first end of the elastic support on the lumbar pillow, is less than a minimum height of the second end of the elastic support on the lead screw.

3. The structure for adjusting the support force of the lumbar pillow according to claim 2, wherein the adjustment mechanism further comprises a horizontal rotation shaft; wherein the horizontal rotation shaft is rotatably connected to the backrest bracket, two ends of the horizontal rotation shaft extend along a widthwise direction of the backrest bracket and are each fixedly connected to a handle, the handle being disposed outside the backrest bracket, and a middle portion of the horizontal rotation shaft is provided with a driving bevel gear; and a first end of the lead screw is provided with a driven bevel gear, wherein the driven bevel gear is meshed with the driving bevel gear, and the lead screw is arranged to be perpendicular to the horizontal rotation shaft.

4. The structure for adjusting the support force of the lumbar pillow according to claim 3, wherein the elastic support comprises a first arc-shaped elastic piece and a second arc-shaped elastic piece; wherein an inwardly recessed surface of the first arc-shaped elastic piece is arranged to be opposite to an inwardly recessed surface of the second arc-shaped elastic piece, a first end of each of the first arc-shaped elastic piece and the second arc-shaped elastic piece is fixedly connected to a bottom of the back of the lumbar pillow, a second end of the first arc-shaped elastic piece is fixed to the backrest bracket, and a second end of the second arc-shaped elastic piece is provided with the slider.

5. The structure for adjusting the support force of the lumbar pillow according to claim 4, wherein the adjustment mechanism further comprises a connection plate, a first fixing seat, and a second fixing seat; wherein the connection plate is fixed to a side of the backrest bracket opposite to the back of the lumbar pillow, and the connection plate is provided with a fixing portion; wherein the fixing portion, the first fixing seat, and the second fixing seat are successively spaced apart from top to bottom along the vertical direction of the backrest bracket; wherein the fixing portion is fixedly connected to the second end of the first arc-shaped elastic piece, wherein the first fixing seat is rotatably connected to a second end of the lead screw, and the second fixing seat is rotatably connected to the first end of the lead screw and the horizontal rotation shaft.

6. The structure for adjusting the support force of the lumbar pillow according to claim 5, wherein the second fixing seat is provided with an accommodating groove that is fitted with the driving bevel gear and the driven bevel gear, such that the driving bevel gear and the driven bevel gear are mounted on the second fixing seat.

7. The structure for adjusting the support force of the lumbar pillow according to claim 4, wherein a third arc-shaped elastic piece is further arranged between the first arc-shaped elastic piece and the second arc-shaped elastic piece; wherein an inwardly recessed surface of the third arc-shaped elastic piece is opposite to the first arc-shaped elastic piece, a first end of the third arc-shaped elastic piece is fixedly connected to the backrest bracket, and a second end of the third arc-shaped elastic piece is slidably sleeved onto a middle section of the second arc-shaped elastic piece proximal to the lumbar pillow.

8. The structure for adjusting the support force of the lumbar pillow according to claim 7, wherein two sides of an end, proximal to the lumbar pillow, of the third arc-shaped elastic piece, are respectively provided with a first lateral stop portion and a second lateral stop portion; wherein a surface, facing the second lateral stop portion, of a bottom of the first lateral stop portion is provided with a first abutting portion, a surface, facing the first lateral stop portion, of a bottom of the second lateral stop portion is provided with a second abutting portion, the second arc-shaped elastic piece is disposed between the first lateral stop portion and the second lateral stop portion, and a bottom of the second arc-shaped elastic piece is disposed above tops of the first abutting portion and the second abutting portion.

9. The structure for adjusting the support force of the lumbar pillow according to claim 7, wherein a lateral side of a top of the second end of at which the third arc-shaped elastic piece slidably connected to the second arc-shaped elastic piece is provided with a display port, and the second arc-shaped elastic piece in a position corresponding to the display port is provided with a position scale mark; wherein the position scale mark is arranged along a direction in which the second arc-shaped elastic piece is slidable relative to the third arc-shaped elastic piece, and the position scale mark is configured to indicate a magnitude of an elastic force applied by the elastic support to the lumbar pillow.

10. The structure for adjusting the support force of the lumbar pillow according to claim 9, wherein the position scale mark is a plurality of color blocks successively arranged on a lateral side of a top of the second arc-shaped elastic piece along the lengthwise direction thereof, and disposed along the direction from the first end of the second arc-shaped elastic piece to the second end of the second arc-shaped elastic piece.

11. The structure for adjusting the support force of the lumbar pillow according to claim 3, wherein the handle is cylindrical and the driving bevel gear is coaxially arranged on the horizontal rotation shaft, and an outer circumferential wall of the handle is provided with at least one position mark; wherein each of the at least one position mark comprises a plurality of circular protrusions spaced apart from each other around a circumferential direction of the handle, radii of the plurality of circular protrusions progressively decreasing or increasing along the circumferential direction of the handle, and the position mark is configured to indicate a rotation direction for adjusting the magnitude of the support force.

12. The structure for adjusting the support force of the lumbar pillow according to claim 1, wherein a backrest is fixedly connected to a front side of the backrest bracket; wherein a bottom of the backrest is flexibly connected to the top of the lumbar pillow.

13. The structure for adjusting the support force of the lumbar pillow according to claim 1, wherein the first end of the elastic support is connected to a middle portion of a back of the lumbar pillow or a bottom of a back of the lumbar pillow.

14. The structure for adjusting the support force of the lumbar pillow according to claim 1, wherein along the vertical direction of the backrest bracket, a minimum height of the first end of elastic support on the lumbar pillow is greater than a maximum height of the second end of elastic support on the lead screw.

15. A chair, comprising the structure for adjusting the support force of the lumbar pillow, wherein the structure for adjusting the support force of the lumbar pillow comprises:

a backrest bracket, a lumbar pillow, an elastic support, and an adjustment mechanism; wherein a top of the lumbar pillow is flexibly connected to a front side of the backrest bracket;

a first end of the elastic support is connected to a back of the lumbar pillow, and a second end of the elastic support is provided with a slider, the slider being provided with an internally threaded hole;

the adjustment mechanism comprises a lead screw, wherein the lead screw runs through the internally threaded hole, the lead screw is rotatably connected to the backrest bracket, and an extension direction of a rotation axis of the lead screw with respect to the backrest bracket is consistent with a vertical direction of the backrest bracket; and in response to the lead screw rotating with respect to the backrest bracket, the slider slides upward and downward along the vertical direction of the backrest bracket to change a support angle of the elastic support for the lumbar pillow, such that a magnitude of the support force of the elastic support to the lumbar pillow is adjusted.

16. The chair according to claim 15, wherein in the vertical direction of the backrest bracket, a maximum height of the first end of the elastic support on the lumbar pillow is less than a minimum height of the second end of the elastic support on the lead screw.

17. The chair according to claim 16, wherein the adjustment mechanism further comprises a horizontal rotation shaft; wherein the horizontal rotation shaft is rotatably connected to the backrest bracket, two ends of the horizontal rotation shaft extend along a widthwise direction of the backrest bracket and are each fixedly connected to a handle, the handle being disposed outside the backrest bracket, and a middle portion of the horizontal rotation shaft is provided with a driving bevel gear; and a first end of the lead screw is provided with a driven bevel gear, wherein the driven bevel gear is meshed with the driving bevel gear, and the lead screw is arranged to be perpendicular to the horizontal rotation shaft.

18. The chair according to claim 17, wherein the elastic support comprises a first arc-shaped elastic piece and a second arc-shaped elastic piece; wherein an inwardly recessed surface of the first arc-shaped elastic piece is arranged to be opposite to an inwardly recessed surface of the second arc-shaped elastic piece, a first end of each of the first arc-shaped elastic piece and the second arc-shaped elastic piece is fixedly connected to a bottom of the back of the lumbar pillow, a second end of the first arc-shaped elastic piece is fixed to the backrest bracket, and the second arc-shaped elastic piece is provided with the slider.

19. The chair according to claim 18, wherein a third arc-shaped elastic piece is further arranged between the first arc-shaped elastic piece and the second arc-shaped elastic piece; wherein an inwardly recessed surface of the third arc-shaped elastic piece is opposite to the first arc-shaped elastic piece, a first end of the third arc-shaped elastic piece is fixedly connected to the backrest bracket, and a second end of the third arc-shaped elastic piece is slidably sleeved onto a middle section of the second arc-shaped elastic piece proximal to the lumbar pillow.

20. The chair according to claim 19, wherein two sides of an end, proximal to the lumbar pillow, of the third arc-shaped elastic piece, are respectively provided with a first lateral stop portion and a second lateral stop portion; wherein a surface, facing the second lateral stop portion, of a bottom of the first lateral stop portion is provided with a first abutting portion, a surface, facing the first lateral stop portion, of a bottom of the second lateral stop portion is provided with a second abutting portion, the second arc-shaped elastic piece is disposed between the first lateral stop portion and the second lateral stop portion, and a bottom of the second arc-shaped elastic piece is disposed above tops of the first abutting portion and the second abutting portion.

* * * * *